US010994974B2

(12) United States Patent
Busuttil et al.

(10) Patent No.: US 10,994,974 B2
(45) Date of Patent: May 4, 2021

(54) TOWER ELEVATING ASSEMBLY

(71) Applicant: Homecare Products, Inc., Algona, WA (US)

(72) Inventors: John Busuttil, Kirkland, WA (US); David A. Bailie, Kent, WA (US); Charles Klyn, Seattle, WA (US)

(73) Assignee: Homecare Products, Inc., Algona, WA (US)

( * ) Notice: Subject to any disclaimer, the term of this patent is extended or adjusted under 35 U.S.C. 154(b) by 0 days.

(21) Appl. No.: 16/827,685

(22) Filed: Mar. 23, 2020

(65) Prior Publication Data

US 2020/0223678 A1 Jul. 16, 2020

Related U.S. Application Data

(63) Continuation of application No. 13/652,310, filed on Oct. 15, 2012, now Pat. No. 10,597,274.

(60) Provisional application No. 61/560,190, filed on Nov. 15, 2011.

(51) Int. Cl.
*B66F 11/04* (2006.01)

(52) U.S. Cl.
CPC ..... *B66F 11/04* (2013.01)

(58) Field of Classification Search
CPC ..... B66F 11/00; B66F 11/04; B66F 11/046; B66F 11/042; B66F 11/044; B66F 9/00; B66F 9/02; B66F 9/04
USPC ..... 187/200–202, 240–244, 226; 414/540, 414/921; 182/37, 62.5, 63.1, 69.4, 69.6, 182/101–103, 141, 148, 149
See application file for complete search history.

(56) References Cited

U.S. PATENT DOCUMENTS 3,661,228 A 5/1972 Glasser
3,984,014 A * 10/1976 Pohl ..... B60P 1/4442 414/546
4,024,972 A * 5/1977 Hobson ..... B66F 9/08 414/607
4,124,096 A * 11/1978 Dudynskyj ..... B60P 1/4421 187/200
4,557,353 A * 12/1985 Pichon ..... B66B 9/187 187/239

(Continued)

OTHER PUBLICATIONS

"Trus-T-LiftTM," Product Information, © 2011 RAM Manufacturing Ltd., Edmonton, Canada, <http://www.trustram.com/res_lifts_features.html> [retrieved Jan. 1, 2013], 2 pages.

(Continued)

*Primary Examiner* — Alvin C Chin-Shue
*Assistant Examiner* — Shiref M Mekhaeil
(74) *Attorney, Agent, or Firm* — Polsinelli PC; Emily C. Peyser

(57) ABSTRACT

A tower elevating assembly generally includes a platform assembly configured to move between a first elevation position and a second elevation position, a tower having a track assembly, wherein the track assembly includes first and second track portions, each being a single continuous structure, and a carriage assembly for providing support to the platform and moving within the track. A kit for a tower elevating assembly includes a platform assembly, a tower having a track assembly, and a carriage assembly configured for coupling with the platform assembly and the tower.

16 Claims, 9 Drawing Sheets

(56) References Cited

U.S. PATENT DOCUMENTS 4,619,346 A * 10/1986 Deguerry ..... B66F 11/04 187/243
4,657,471 A * 4/1987 Shinoda ..... B66F 9/061 187/226
4,828,450 A * 5/1989 Adamski ..... B66F 9/195 414/607
4,919,236 A 4/1990 Karlsson et al.
5,143,507 A * 9/1992 Haugen ..... B60B 29/00 254/2 B
5,450,929 A * 9/1995 Ohgita ..... B66F 9/07 187/244
5,499,694 A * 3/1996 Dorn ..... A61G 5/1059 187/200
5,645,142 A * 7/1997 Kraemer ..... B66B 5/22 182/148
5,850,892 A * 12/1998 Citron ..... B66F 11/04 182/148
5,901,812 A 5/1999 Meunier
6,082,506 A * 7/2000 Huang ..... B66D 5/16 187/372
6,168,138 B1 * 1/2001 Dhein ..... B25H 1/0014 254/134
6,640,934 B1 * 11/2003 Edwards ..... B66B 9/00 182/141
6,676,233 B1 * 1/2004 Evans ..... B66B 9/02 108/147.11
6,883,641 B2 * 4/2005 Julien ..... B66F 11/042 182/141
7,395,900 B2 * 7/2008 Murray ..... B66B 9/0869 187/200
8,534,422 B2 * 9/2013 Solhjenn ..... B66F 11/04 182/141
8,584,801 B2 * 11/2013 Baxter ..... E04G 21/166 182/82
8,636,111 B2 1/2014 Anasis et al.
8,733,508 B2 * 5/2014 Bacon ..... B66F 7/065 187/269
10,160,629 B2 * 12/2018 Wenjing ..... B66F 11/04
10,723,607 B2 * 7/2020 Wenjing ..... B66F 17/006
2007/0267250 A1 * 11/2007 Wolff ..... E06C 7/081 182/103
2008/0308358 A1 * 12/2008 Zuercher ..... B66B 9/0807 187/200
2010/0111661 A1 * 5/2010 Svanda ..... B66C 23/48 414/543
2011/0120801 A1 5/2011 Stromland et al.
2012/0073908 A1 3/2012 Rosenthal
2012/0228064 A1 * 9/2012 Busuttil ..... B66F 9/087 187/226

OTHER PUBLICATIONS

"PL-P Wheelchair Lift," Product Information, © 2013 ThyssenKrupp Access, Grandview, Mo., <htttp://www.tkaccess.com/wheelchair-lifts/plp/wheelchairLifts_plp.aspx> [retrieved Jan. 1, 2013], 2 pages.
"Wheelchair Lifts," Product Brochure, © 2011 ThyssenKrupp Access, Grandview, Mo., <htttp://www.tkaccess.com/wheelchair-lifts/assets/tka_wheelchair_brochure.pdf>, Jun. 2011, 12 pages.

* cited by examiner

TOWER ELEVATING ASSEMBLY

CROSS-REFERENCE TO RELATED APPLICATIONS

This application is a continuation of application Ser. No. 13/652,310, filed Oct. 15, 2012, now issued as U.S. Pat. No. 10,597,274, which claims the benefit of U.S. Provisional Patent Application No. 61/560,190, filed Nov. 15, 2011, the disclosures of which are hereby expressly incorporated by reference herein.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, a tower elevating assembly is provided. The tower elevating assembly generally includes a platform assembly configured to move between a first elevation position and a second elevation position, a tower having a track assembly, wherein the track assembly includes first and second track portions, each being a single continuous structure, and a carriage assembly for providing support to the platform and moving within the track.

In accordance with another embodiment of the present disclosure, a tower elevating assembly is provided. The tower elevating assembly generally includes a platform assembly configured to move between a first elevation position and a second elevation position, a tower having a track assembly, a carriage assembly for providing support to the platform and moving within the track, and a user control interface configured to include visual indicators to assist the user in controlling the system.

In accordance with another embodiment of the present disclosure, a kit for a tower elevating assembly is provided. The kit generally includes a platform assembly, including a platform, a tower having a track assembly, wherein the track assembly includes first and second track portions, each being a single continuous structure, and a carriage assembly configured for coupling with the platform assembly and the tower assembly.

In accordance with another embodiment of the present disclosure, a tower elevating assembly is provided. The tower elevating assembly includes: (a) a platform assembly configured to move between a first elevation position and a second elevation position, the platform assembly having a first and second ends and a platform therebetween, the platform having a longitudinal axis; (b) a single stage tower supporting the platform assembly, the single stage tower located near to the first end of the platform assembly and spaced from the second end of the platform assembly, the tower having a first end and a second end and including a track assembly, wherein the track assembly includes first and second track portions extending between the first and second ends of the tower, wherein each of the first and second track portions includes at least first and second adjacent channels, wherein each of the first and second track portions is manufactured as a single continuous extruded structure made from extruded aluminum, and wherein a portion of the single continuous structure of each of the first and second track portions defines the at least first and second adjacent channels of the respective first and second track portions, wherein the first and second track portions are arranged such that the openings to both of the at least first and second channels of the first track portion face the openings to both of the at least first and second open channels of the second track portion, wherein the tower further includes a leg assembly extending from a base of the tower, and wherein the tower is configured to be anchored to a ground surface by base attachments points located on the leg assembly; and (c) a carriage assembly for providing support to the platform assembly, the carriage assembly having a first end adjacent the tower for supporting the first end of the platform assembly and a second end spaced from the tower for supporting the second end of the platform assembly, and the carriage assembly including a tower interface at the first end configured for moving first and second rollers within the first channels of the first and second track portions, wherein the first and second rollers are configured to rotate about an axis parallel to the longitudinal axis of the platform, wherein the platform assembly is configured to move along the track assembly between the first elevation position at the first end of the tower to the second elevation position at the second end of the tower, wherein a vertical reach of the platform assembly is limited to a length of the single continuous extruded aluminum first and second track portions.

In accordance with another embodiment of the present disclosure, a kit for a tower elevating assembly is provided. The kit includes: (a) a platform assembly, including a platform having a first and second guard wall, respectively, on first and second ends of the platform and a ramp between the first and second guard walls to enclose the platform, the ramp being retractable to provide an exit from the platform; (b) a single stage tower having a first end and a second end and including a track assembly, wherein the track assembly includes first and second track portions extending between the first and second ends of the tower, wherein each of the first and second track portions includes at least first and second adjacent channels, wherein each of the first and second track portions is manufactured as a single continuous structure made from extruded aluminum, and wherein a portion of the single continuous structure of each of the first and second track portions divides the first and second adjacent channels of the respective first and second track portions, wherein the first and second track portions are configured such that the openings to both of the at least first and second channels of the first track portion face the openings to both of the at least first and second open channels of the second track portion, wherein the tower further includes a leg assembly extending from a base of the tower, and wherein the tower is configured to be anchored to a ground surface by base attachments points located on the leg assembly; and (c) a carriage assembly configured for coupling with the platform assembly and the tower assembly and configured for movement within the first channels of the first and second track portions, wherein the carriage assembly includes first and second rollers configured for moving within the first channels of the first and second track portions, wherein the first and second rollers are configured to rotate about an axis parallel to the longitudinal axis of the platform, wherein the platform assembly is configured to move along the track assembly between a first elevation position at the first end of the tower to a second elevation position at the second end of the tower, wherein a vertical reach of the platform assembly is limited to a length of the single continuous extruded aluminum first and second track portions.

DESCRIPTION OF THE DRAWINGS

The foregoing aspects and many of the attendant advantages of this disclosure will become more readily appreciated by reference to the following detailed description, when taken in conjunction with the accompanying drawings, wherein.

DETAILED DESCRIPTION

Figure 1:
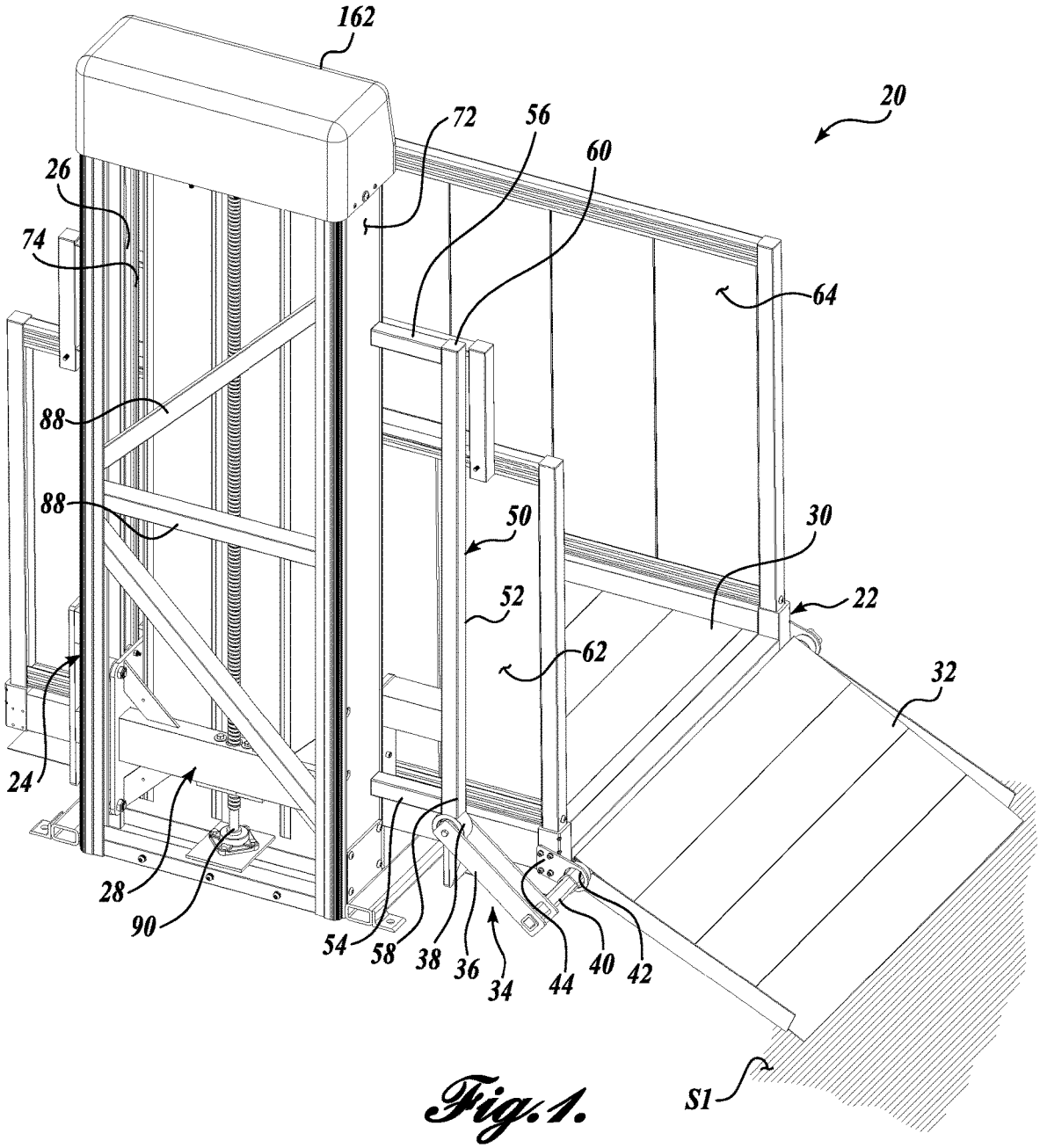
FIG. 1 is a back side isometric view of a lift assembly in a first elevation position in accordance with one embodiment of the present disclosure.

Embodiments of the present disclosure are generally directed to lift assemblies, for example, personal access lift assemblies for elevating a person from a first elevation position to a second elevation position. Referring to FIG. 1, a lift assembly 20 in accordance with one embodiment of the present disclosure is shown. The lift assembly 20 includes a platform assembly 22 configured to be movable between a first (e.g., down) elevation position S1 (see FIG. 1) and a second (e.g., up) elevation position S2 (see FIG. 3). The lift assembly 20 further includes a tower assembly 24 including a track assembly 26. A carriage assembly 28 provides support to the platform assembly 22 and moves within the track assembly 26.

Although shown and described as a personal access lift assembly, for example, for a person in a wheelchair to traverse a set of stairs by moving on the lift assembly 20 from a first elevation position to a second elevation position, it should be appreciated that other types of lift assemblies are also within the scope of the present disclosure, such as lifts for loads rather than for persons. Further, it should be appreciated that embodiments of the lift assembly described herein may be sized to accommodate various elevation positions. As non-limiting examples, various embodiments of the lift assemblies described herein may be configured to elevate platform assemblies up to about 72 inch, 52 inch, and 32 inches in height differential, for example, between a first elevation positions S1 (see, e.g., FIG. 1) and a second elevation position S2 (see, e.g., FIG. 3).

As described in greater detail below, many of the components of the lift assembly 20 may be formed from extruded aluminum, providing several advantages over previously designed lift assemblies manufactured from welded steel. Extruded aluminum reduces parts in the overall system, thereby reducing manufacturing and assembly costs, as well as operational noise generated by rattling part couplings. Moreover, extruded aluminum parts achieve the same strength and stiffness requirements as steel construction, while having reduced weight over steel parts, allowing for improved ease of assembly and optimized part design. For example, the overall weight of a lift assembly 20 designed in accordance with embodiments of the present disclosure may be less than 400 lbs, while a previously designed lift assembly may be in the range of about 700 to about 800 lbs.

Figure 2:
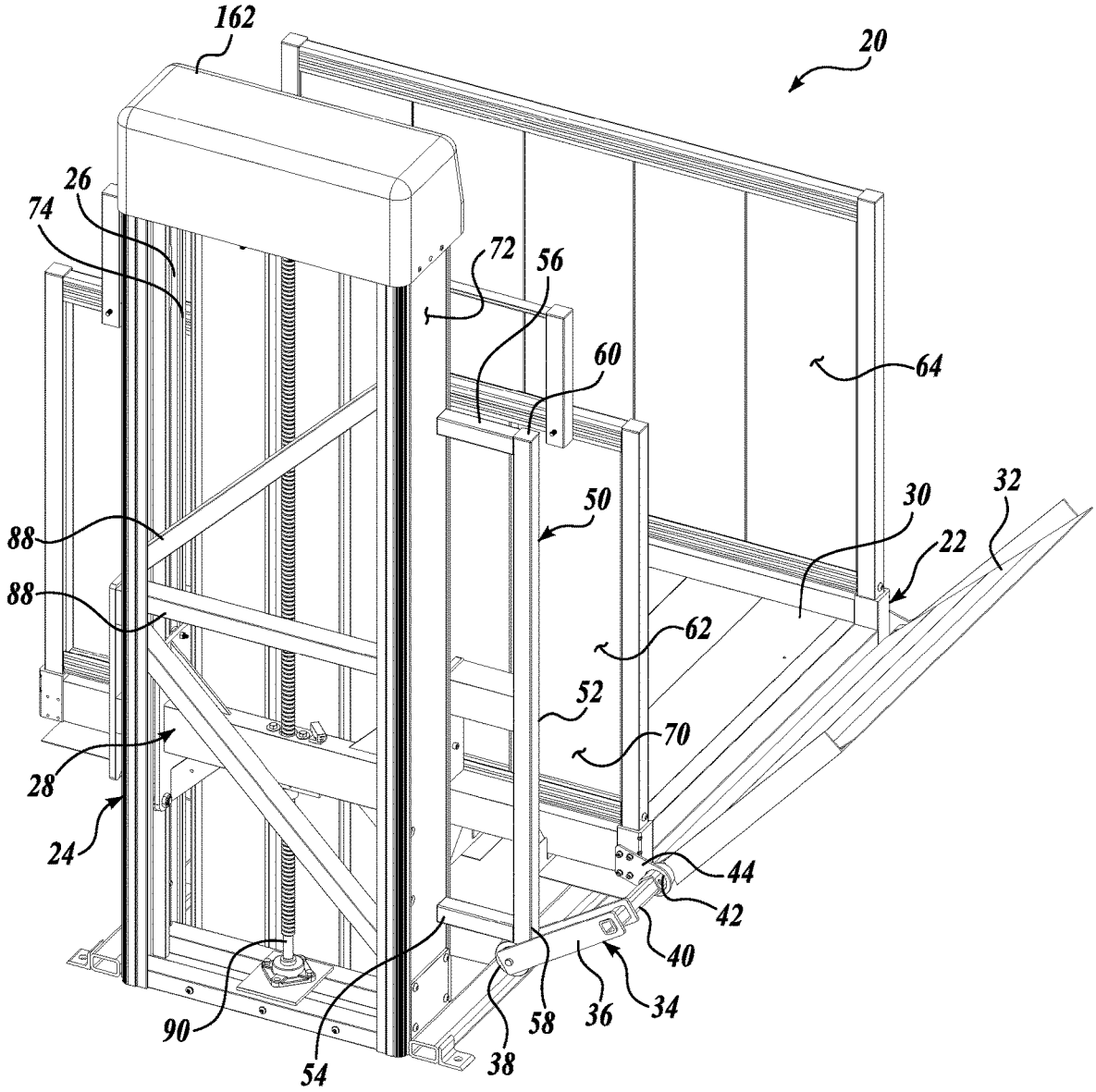
FIG. 2 is a back side isometric view of the lift assembly of FIG. 1 in an intermediate elevation position between first and second elevation positions.
Figure 3:
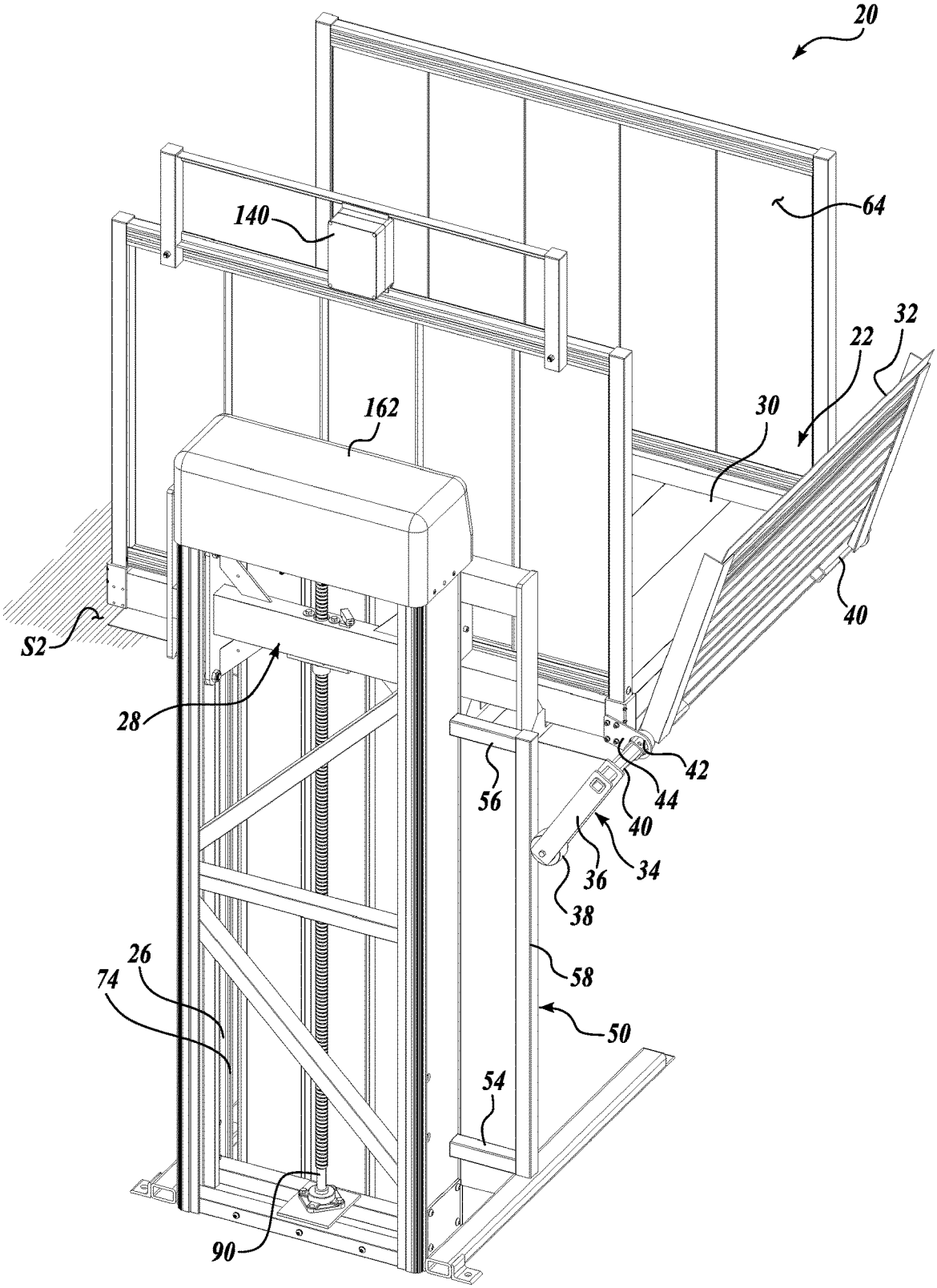
FIG. 3 is a back side isometric view of the lift assembly of FIG. 1 in a second elevation position.

Referring to FIGS. 1-3, the platform assembly 22 of the lift assembly 20 will now be described. The platform assembly 22 includes a substantially horizontal platform 30 for providing a lifting surface for the user. In one embodiment of the present disclosure, the platform 30 is a stable substantially horizontal surface capable of holding weight up to about 750 pounds. However, it should be appreciated that other weight capacity limits are within the scope of the present disclosure. The platform 30 is configured to move vertically up and down, but has enough strength, stiffness, and support to limit rotational movement, particularly under asymmetrical load scenarios.

The platform assembly 22 includes a first ramp 32 extending from the first end of the platform 30 to provide access for a user between a first surface S1 (see FIG. 1) and the platform 30, as will be described in greater detail below. As can be seen by comparing FIGS. 1-3, the first ramp 32 retracts to a guarding position when the ramp is moving from the first (e.g., down) elevation position (see FIG. 1), to a transition position (see FIG. 2), and to the second (e.g., up) elevation position (see FIG. 3). Such retraction prevents the user or the load from accidentally falling off the platform assembly 22 during movement.

The platform assembly 22 may also include a gate assembly (not shown) for user protection on the other end of the platform assembly 22. It should be appreciated that the first ramp 32 may positioned at either end of the platform 30, and likewise for a gate assembly (not shown), depending on the desired configuration of the lift assembly 20.

In the illustrated embodiment, the first ramp 32 is cam actuated. In that regard, a pivot arm assembly 34 drives the first ramp 32 between its retracted position (see FIG. 3) and deployed position (see FIG. 1). In the illustrated embodiment of FIGS. 1-3, the pivot arm assembly 34 includes a pivot arm 36 pivotably coupled to a roller 38 at the first end of the pivot arm 36, and fixedly coupled to the first ramp 32 at the second end of the pivot arm 36. At the second end of the pivot arm 36, the fixed coupling of the illustrated embodiment includes a square cross-sectional bar 40 configured to rotate in a circular hole 42 of a mounting bracket 44 that is attached to the platform 30. Therefore, the first ramp 32 is configured to hinge relative to the platform 30 as pivot arm 36 pivots, as described in detail below.

For cam actuation of the first ramp 32, the roller 38 is configured to travel along a rail 50. In that regard, the roller 38 may include flanged ends to maintain its engagement with rail 50. In the illustrated embodiment, the rail 50 has an elongate substantially vertical portion 52 that extends between first and second substantially horizontal end portions 54 and 56. The rail 50 in the illustrated embodiment is shown as being attached to the right side of the tower assembly 24. However, it should be appreciated that the rail 50 may also be a free standing part, and need not be attached to the tower assembly 24. Moreover, the rail 50 and the first ramp 32 may be configured to be on the left side of the tower assembly 24.

In operation, when the roller 38 travels along the substantially vertical portion 52 of the rail 50, the first ramp 32 is in its retracted position (see FIG. 3). When the roller 38 travels along the substantially horizontal portion 54 of the rail 50, the first ramp 32 is in its deployed position (see FIG. 1). When transitioning around the corner 58 between the substantially horizontal portion 54 and the substantially vertical portion 52, the first ramp 32 moves between retracted and deployed positions (see, e.g., FIG. 2).

Like the other components in the system, the first ramp 32 may be made from extruded aluminum (see cross-sectional view in FIG. 9), thereby having a weight reduction over current systems manufactured from steel. Therefore, the first ramp 32 of the present disclosure may be a longer first ramp 32 having a smaller approach angle compared to other lift assemblies on the market.

To further provide protection for the user, the platform assembly 22 may also include first and second guard walls 62 and 64 to serve as guarding sidewalls. The guard walls 62 and 64 together with the first ramp 32 (and, for example, a gate assembly, not shown) provide a substantially enclosed platform assembly 22 for the user to prevent the user from accidentally falling off the platform assembly 22 during movement of the lift assembly 20.

Figure 5:
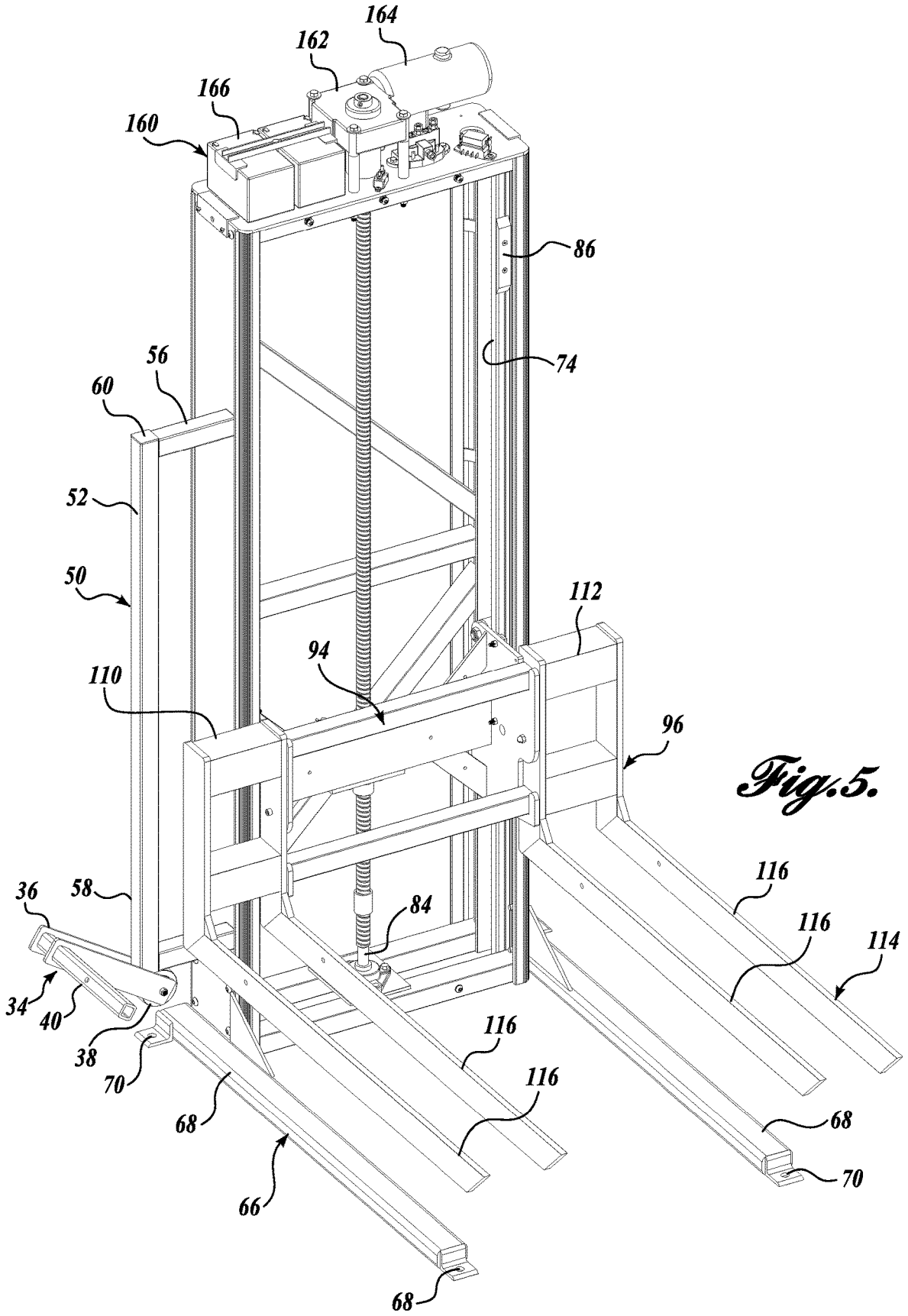
FIG. 5 is a front isometric view of carriage and tower assemblies of the lift assembly (with the platform assembly removed) shown in FIG. 1.

A carriage assembly 28 provides support for the platform assembly 22 and enables movement of the platform assembly 22 between first and second elevation positions S1 and S2. Referring to FIG. 5, in which the platform assembly 22 has been removed, the carriage assembly 28 will now be described in greater detail. The carriage assembly 28 includes is configured to travel along the track assembly 26 in the tower assembly 24 (see FIG. 6) and also to support the platform assembly 22 (see also FIG. 7). Although shown as being removed from its coupling to the carriage assembly 28 in FIG. 5, the platform assembly 22 may be coupled to the carriage assembly 28, for example, by fastener coupling or by welding (see, e.g., FIG. 8).

Figure 4:
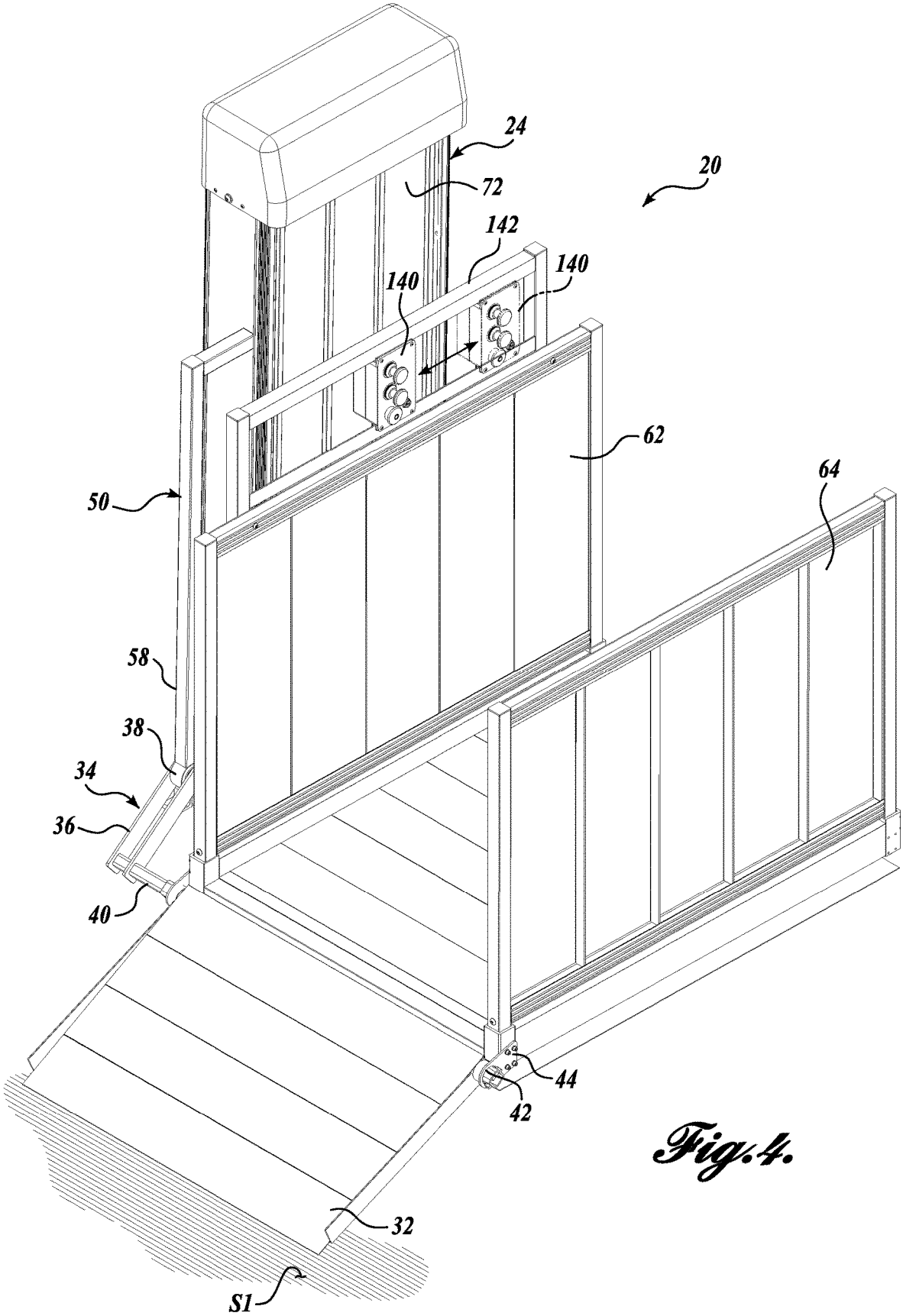
FIG. 4 is a front side isometric view of the lift assembly of FIG. 1 in the first elevation position.

Before describing the details of the carriage assembly 28, the tower assembly 24 will be described in greater detail. Referring to FIGS. 1 and 4, the tower assembly 24 is a substantially vertical structure that is essentially the "backbone" of the lift assembly 20. In that regard, the tower assembly 24 is a structural assembly that assists in the lifting of the platform assembly 22. The tower assembly 24 also includes a housing 72 for providing an exterior attachment surface for other components of the lift assembly 20 (such as the cam rails 50) and also for protecting the structural components disposed therein. In the illustrated embodiment, the housing 72 is defined by the other surfaces of first and second vertical track portions 74, and front and back covers (see cover in FIG. 4) that may be installed to protect the internal components of the tower assembly 24.

As can be seen in FIG. 5, the tower assembly 24 includes a base 66 for structural stability that is attachable to a ground surface S1. In the illustrated embodiment, the base 66 includes a plurality of legs 68. In one non-limiting example, the lift assembly 20 is installed on a poured concrete slab, and the base 66 of the tower assembly 24 is configured to be anchored to the slab at base attachment points 70 located on legs 68.

Figure 6:
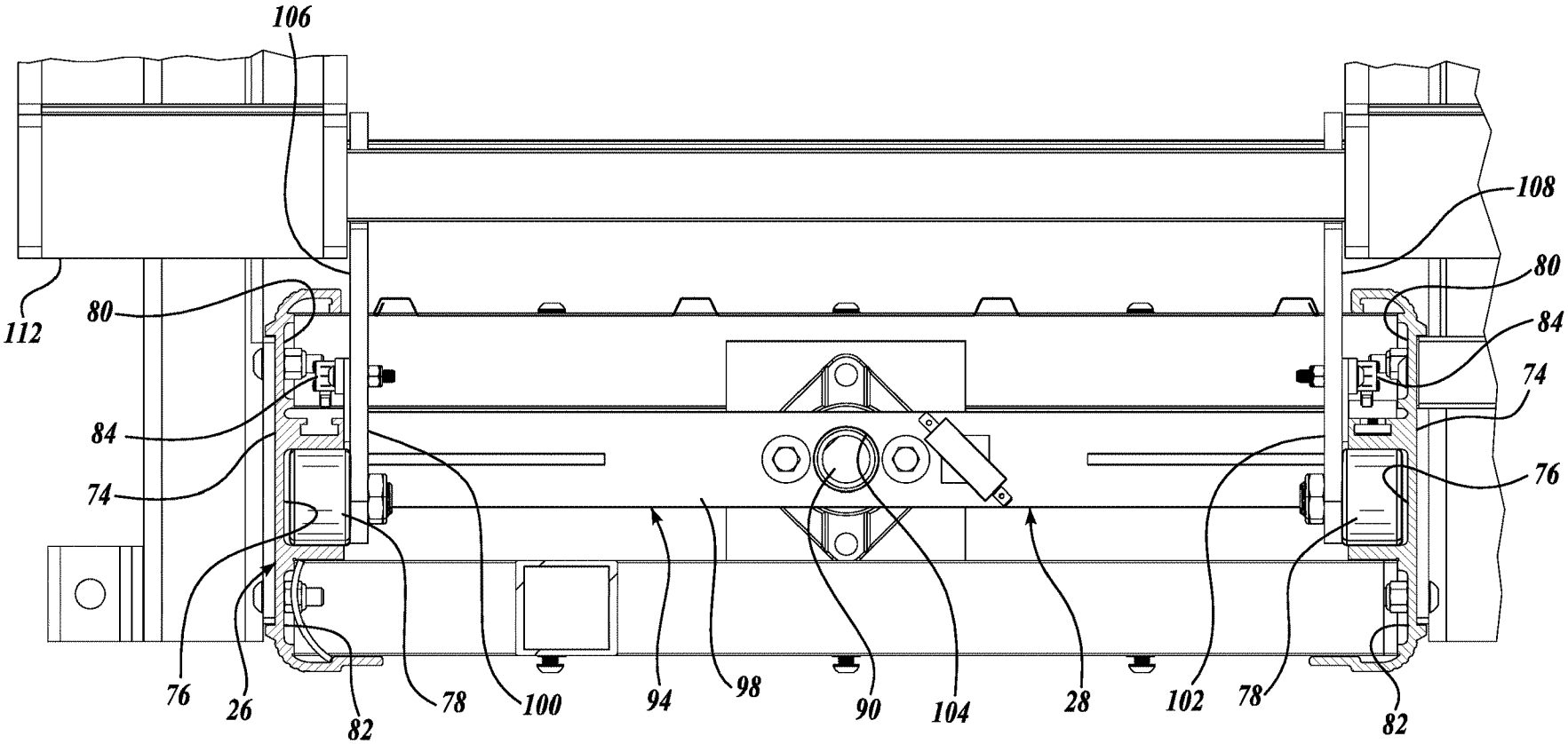
FIG. 6 is a cross-sectional view of the carriage and tower assemblies (with the platform assembly removed) of the lift assembly shown in FIG. 1.

A track assembly 26 extends vertically inside the tower assembly 24, and includes two opposing vertical track portions 74 along which the carriage assembly 28 is configured for movement (see FIG. 6). In that regard, the tower assembly 24 generally provides a structure that includes a track assembly 26 for guiding the carriage assembly 28 as it moves up and down supporting the platform assembly 22. Therefore, the tower assembly 24 provides both linear and radial support to the carriage assembly 28 as it in turn supports the platform assembly 22.

In the illustrated embodiment, the vertical track portions 74 each include a first channel 76 for receiving rollers 78 (see FIG. 7) that enable movement of the carriage assembly 28. The vertical track portions 74 may also include other channels, such as second and third channels 80 and 82 for accommodating other components of the tower assembly 24 and/or the carriage assembly 28. For example, the second channel 80 may be configured to allow passage of circuitry 84 carriage assembly 28, such as circuitry for limit switch devices. In that regard, the tower assembly 24 further may include attachment points 86 (see FIG. 5) along the vertical track portions 74 of the track assembly 26 for limit switch triggers that are actuated by the vertical movement of the carriage assembly 28 relative to the track assembly 26.

In the illustrated embodiment, the vertical track portions 74 of the track assembly 26 are configured as single continuous structures or continuous channels, e.g., without welds or seams. As a non-limiting example, the vertical track portions 74 are extruded aluminum channels, extruded as single continuous channels. Comparatively, track assemblies in previously designed lift assemblies are typically made from steel for strength purposes. Therefore, the previously designed track assemblies are either welded or bolted together resulting in seams when formed.

The extruded track design has several advantages over previously designed tracks that are typically made from multiple steel elements that are welded or bolted together. First, the extruded design provides for ease of manufacturing. Not only is extrusion a simplified manufacturing process as compared to welding or bolt attachment, but it also decreases the chances of manufacturing errors and misalignments of features. Such extrusion thereby improves the consistency of performance and reliability for the track. Moreover, reduction of weight and parts allows for a more compact overall design.

Second, the extruded design allows for improved noise reduction, as compared to a steel constructed lift assembly. In that regard, fewer part connections (for example, by welding or bolt attachment) allow for reduced rattling of parts at couplings. Third, the extruded design allows for equivalent strength, as compared to a steel constructed lift assembly, with lighter materials.

To provide additional structural support, the tower assembly 24 further may include one or more cross pieces 88 extending between the first and second vertical track portions 74. The cross pieces 88 may be configured in any suitable arrangement to provide structural support to the tower assembly 24 and the overall lift assembly 20.

As discussed above with reference to FIGS. 1-3, the carriage assembly 28 is translatable along a linear path between a first elevation position S1 (FIG. 1) and a second elevation position S2 (FIG. 3). In the illustrated embodiment, the carriage assembly 28 is moved by a screw 90 within the tower assembly 24.

In one embodiment of the present disclosure, the screw 90 for moving the carriage assembly 28 within the tower assembly 24 is a high-efficiency power transmission screw, for example a HI-LEAD® screw manufactured by ROTON®. High-efficiency screws provide faster linear travel than other types of transmission screws, for example, and Acme screw. In that regard, high-efficiency screws use multiple start threads to increase the thread lead, and thereby increase the linear movement output for each revolution of rotary input.

One advantage of using a high-efficiency power transmission screw is a decrease in rotations per minute of the screw 90, which results in significantly less vibration in the system, as compared to a lower efficiency screw to drive the same movement. In one embodiment, the screw transmission is powered by a gear 162 and motor 164 that are designed to run directly from one or more batteries 166 (see FIG. 5). However, it should be appreciated that other systems are also within the scope of the present disclosure, such as other types of gear motors, direct drive motors, belt drives, or low efficiency screws.

Figure 7:
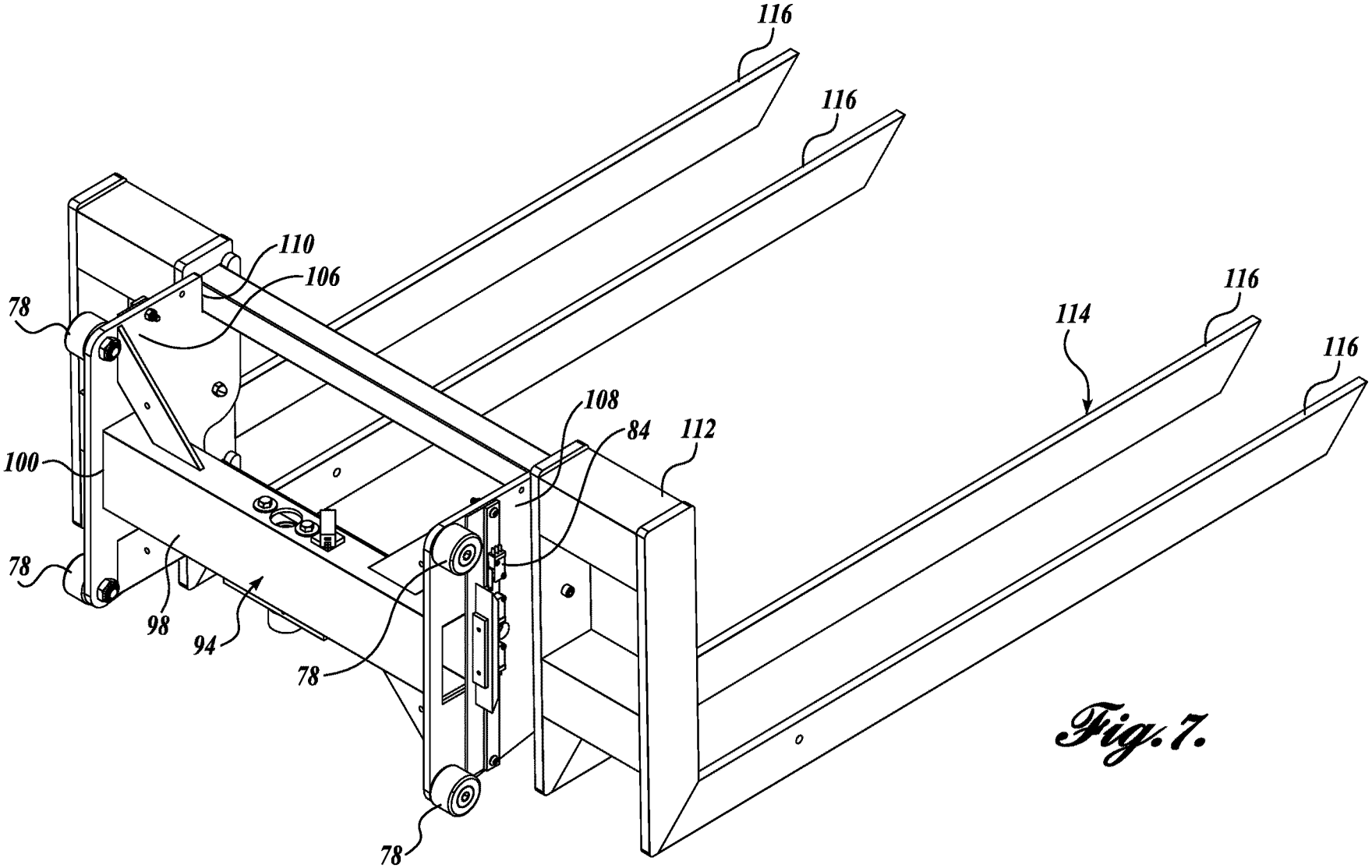
FIG. 7 is a back isometric view of the carriage assembly of the lift assembly of FIG. 1.

Referring to FIGS. 5-7, the carriage assembly 28 will now be described in greater detail. The carriage assembly 28 includes a tower traveling assembly 94 and a platform support assembly 96. Referring to FIGS. 6 and 7, the tower traveling assembly 94 includes a body portion 98 having first and second ends 100 and 102, and a hole 104 extending through the body portion 98 for receiving a screw nut (not shown) and the lifting screw 90. The screw 90 drives the nut, which is turn drives the carriage assembly 28 (and by extension the platform assembly 22). In one embodiment of the present disclosure, the carriage assembly 28 may include a secondary safety nut in the event that the first nut fails.

At each of the first and second ends 100 and 102 of the body portion 98, the tower traveling assembly 94 includes side plates 106 and 108 to which rollers 78 and circuitry 84 are mounted. The side plates 106 and 108 further include detents 110 for receiving and coupling with the platform support assembly 96. In that regard, the platform support assembly 96 may be easily separated from the tower traveling assembly 94 for shipping, warehousing, and repair.

The platform support assembly 96 is coupled to the tower traveling assembly 94 and is configured to provide support to the platform assembly 22. As can be seen in FIGS. 5 and 7, the support assembly 96 includes a support portion 112 which can be received within detents 110 to couple with and hence be moved by the tower traveling assembly 94. The support assembly 96 further includes a lifting cradle 114, which includes arms or forks 116 that extend outwardly from the support portion 112. While the support assembly 96 is configured to provide lifting support to the platform assembly 22, the plurality of spaced lifting arms or forks 114 also provide rotational support to prevent the platform assembly 22 from rotating under heavy or asymmetrical loads.

Figure 8:
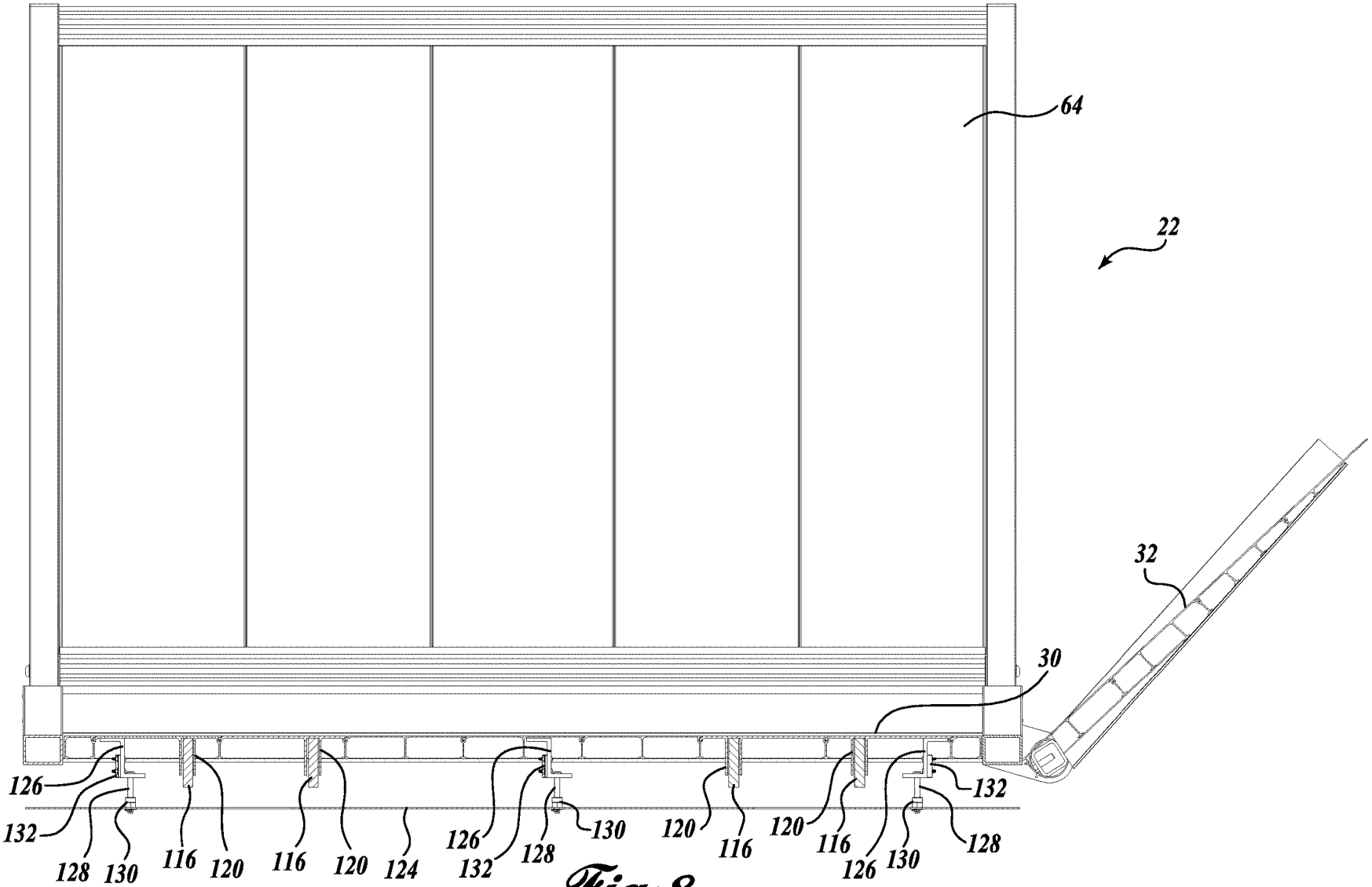
FIG. 8 is a side cross-sectional view of a platform assembly of the lift assembly shown in FIG. 1.

As mentioned above, the platform assembly 22 may be coupled to the support assembly 82, for example, by fastener coupling or by welding. Referring to FIG. 8, one embodiment of an interface between the platform assembly 22 and the support assembly 82 is provided. In that regard, the platform 30 of the platform assembly 22 may be, like the other components in the lift assembly 20, made from extruded aluminum. The extruded structure may include a plurality of arm receiving portions 120 for receiving the arms 116 of the lifting cradle 114 of the support assembly 96. After the arms 116 are received within the arm receiving portions 120, they may be coupled by fasteners or by welding.

The separability of the platform support assembly 96 and the platform 30 has several advantages over previously designed integrated platform assemblies (assuming these parts are not welded together during the manufacturing process). First, the separability allows for the optimization of the individual assemblies. For example, if a differently sized platform 30 is required, the platform support assembly 96 may not need to be redesigned. Second, the parts may be broken down for ease of shipping, warehousing, and repair of the overall lift assembly.

Still referring to FIG. 8, a safety pan assembly 122 extends from the bottom of the platform assembly 22. The assembly 122 includes a pan 124 that extends along substantially the same dimensions as the platform 30. The pan 124 hangs from a plurality of hanging brackets 126 by clevis pins 128 having stopping activators 130. As a non-limiting example, the stopping activators 132 are magnetic reed switches that are tripped when a magnet 130 is within proximity. In operation, if an object is below the platform assembly 22, for example, a toy or a dog, the pan 124 will hit the object and will be forced upwards such that clevis pins 128 retract in holes in the hanging brackets 126. When a stopping activator 132 is activated as a result of proximity to a magnet 130, the lift assembly 20 will immediately stop.

Magnetic reed switches are advantageous over mechanical switches when used in this application because there is no need for physical contact between to trip the switch, only proximity of the magnet. Therefore, the magnetic reed switches can be housed in a casing so that the system is less likely to be affected by debris, snow, or ice, resulting in a more robust system in the field. Although shown and described as a magnetic reed switch, it should be appreciated that other types of stopping activators besides magnetic activators may be used, such as mechanical switches.

Returning to FIG. 4, attached to the platform assembly 22 is a user control interface 140 for controlling the lift assembly 20. The control interface 140 may be movably coupled to the platform assembly 22. For example, in the illustrated embodiment, the control interface 140 is slidably coupled along a track 142, such that a user can reach the control interface 140 when entering the platform 30 on either end.

Figure 9:
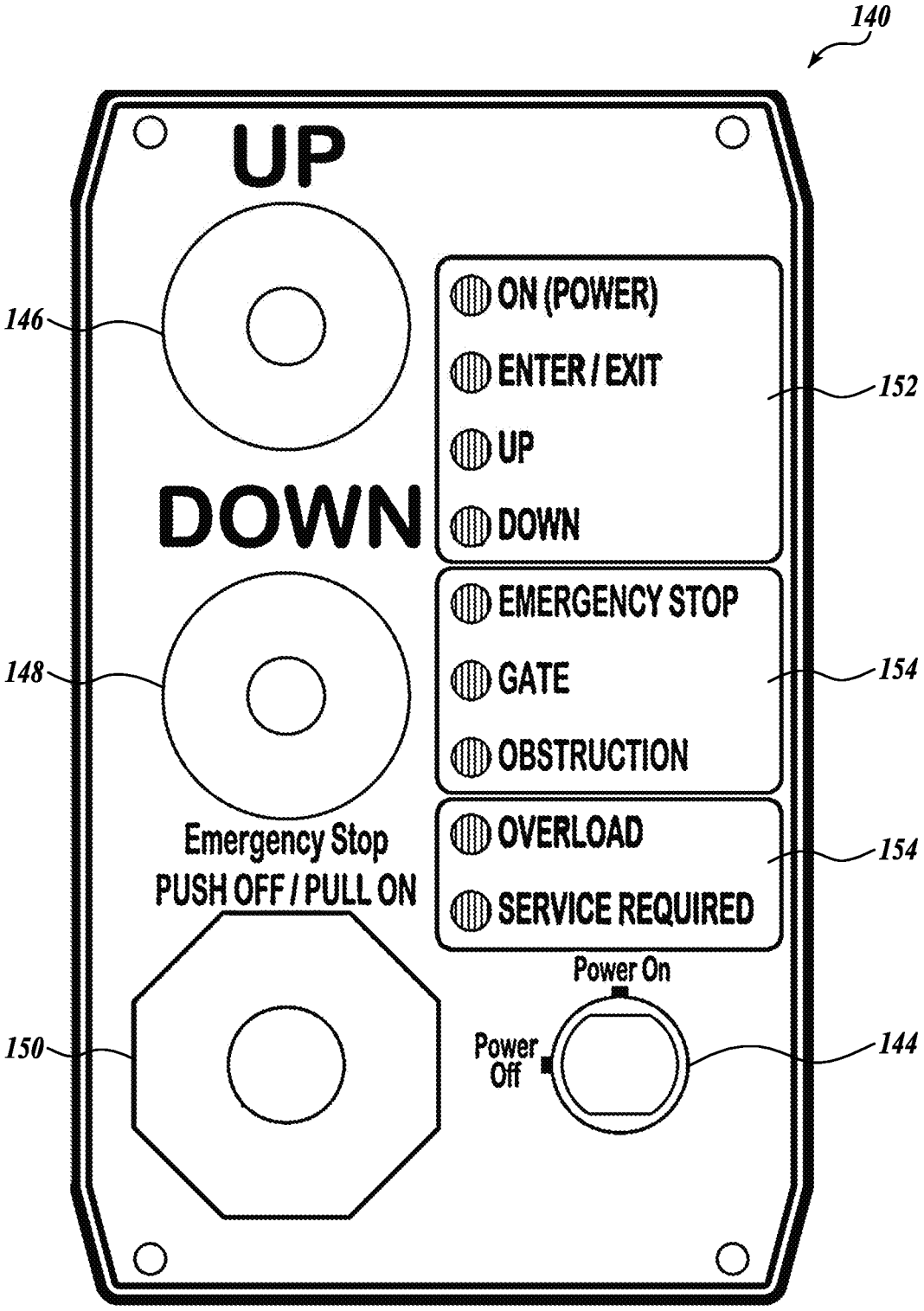
FIG. 9 is a user control interface for the lift assembly of FIG. 1.

Turning now to FIG. 9, the control interface 140 is configured to include visual indicators to assist the user in controlling the system. In that regard, the control interface 140 includes a power on and off switch 144, which may be key-activated, and control buttons for "up" movement 146, "down" movement 148, and emergency stop 150. The control interface 140 further includes status indicators for regular operation 152 to indicate the status of the lift assembly, for example, "power on", "enter or exit" mode, moving "up" or moving "down". The control interface 140 may further include status indicators for trouble shooting problems 154, for example, "emergency stop" button activated, "gate" not secured, "obstruction" under the platform 30, "overload" for exceeding weight limit, or "service required" for other problems.

The control interface 140 described herein is designed to provide visual feedback regarding lift assembly status information to reduce the need for service calls when the problem can be solved by the user. For example, if "emergency stop" button is accidentally activated, the user can trouble shoot the problem by himself or herself by reviewing the status indicators without requiring a service call. By adding multiple visual indicators for user feedback regarding the operation of the lift assembly, the user can assist in troubleshooting real or perceived problems. In that regard, one of the largest complaint areas of service providers on previously developed lift assemblies is service calls as a result of user error or misdiagnosed problems.

Referring to FIG. 5, the power components of the lift assembly 20 are shown. In that regard, the power components are all located in what is called the head portion 160 of the tower assembly 24. The head portion may be covered by a cover 162 (see FIG. 1). The power components may include, for example, one or more batteries and drivers. There are several advantages to the placement of these components in the head portion 160 of the tower assembly 24. First, positioning the components on top of the tower assembly 24 means that the height of the tower assembly can be reduced, thereby reducing the weight and materials of the overall tower assembly 24, as well as the length of the transmission screw 90. Second, by positioning the components on top of the tower assembly 24, the components are easy to reach for installation and repair, and do not require repositioning of the carriage assembly 28 or platform assembly 22 for access. Third, if needed to expedite a repair, the entire head portion 160 may be removed and replaced. Fourth, positioning the drive components on top of the tower assembly 24 keeps the drive components away from any snow, ice, or pooling water that might accumulate at the bottom of the tower assembly 24 during different weather conditions.

The operation of the lift assembly 20 will now be described in greater detail. Referring to FIG. 1, the first ramp 32 is in the down position, and a user can enter the lift assembly 20 to move from a first elevation S1 to a second elevation S2. Referring to FIG. 9, the user turns the power 144 to on and activates the "up" control 146. The "up" control 146 activates the screw 90 to lift the carriage assembly 28, and in turn the platform assembly 22. As the platform assembly 22 starts to move up, the first ramp 32 closes to its retracted position (see FIGS. 2 and 3). Referring to FIG. 3, when the platform assembly 22 reaches the "up" position, the user may exit the lift assembly 20.

To return to the first elevation S1, the user enters the lift assembly 20 and activates the "down" control 148 (see FIG. 9). The "down" control 148 activates the screw 90 to lower the carriage assembly 28, and in turn the platform assembly 22. As the platform assembly 22 moves down, the first ramp 32 opens to its deployed position (see FIG. 1).

While illustrative embodiments have been illustrated and described, it will be appreciated that various changes can be made therein without departing from the spirit and scope of the disclosure.

The embodiments of the disclosure in which an exclusive property or privilege is claimed are defined as follows:

1. A tower elevating assembly, comprising:

(a) a platform assembly configured to move between a first elevation position and a second elevation position, the platform assembly having a first and second ends and a platform therebetween, the platform having a longitudinal axis;

(b) a single stage tower supporting the platform assembly, the single stage tower located near the first end of the platform assembly and spaced from the second end of the platform assembly, the tower having a first end and a second end and including a track assembly, wherein the track assembly includes first and second track portions extending between the first and second ends of the tower, wherein each of the first and second track portions includes at least first and second adjacent channels, wherein each of the first and second track portions is manufactured as a single continuous extruded structure made from extruded aluminum, and wherein a portion of the single continuous structure of each of the first and second track portions defines the at least first and second adjacent channels of the respective first and second track portions, wherein the first and second track portions are arranged such that openings to both of the at least first and second channels of the first track portion face openings to both of the at least first and second channels of the second track portion, wherein the tower further includes a leg assembly extending from a base of the tower, and wherein the tower is configured to be anchored to a ground surface by base attachments points located on the leg assembly; and (c) a carriage assembly for providing support to the platform assembly, the carriage assembly having a first end adjacent the tower for supporting the first end of the platform assembly and a second end spaced from the tower for supporting the second end of the platform assembly, and the carriage assembly including a tower interface at the first end of the carriage assembly configured for moving first and second rollers within the first channels of the first and second track portions, wherein the first and second rollers are configured to rotate about an axis parallel to the longitudinal axis of the platform, wherein the platform assembly is configured to move along the track assembly between the first elevation position at the first end of the tower to the second elevation position at the second end of the tower, wherein a vertical reach of the platform assembly is limited to a length of the single continuous extruded aluminum first and second track portions.

2. The tower elevating assembly of claim 1, wherein the at least first and second channels are defined by a wall portion and first and second end portions, and at least one divider portion extending from the wall portion between the first and second end portions in an orthogonal direction from the wall portion to define the at least first and second channels having openings thereto.

3. The tower elevating assembly of claim 2, wherein each of the first and second end portions have a first end at the wall portion, wherein the transition from the wall portion to each of the first and second end portions is a rounded corner, and a second end extending in an orthogonal direction from the wall portion.

4. The tower elevating assembly of claim 1, wherein an outer side of a wall portion of the first track portion faces away from an outer side of a wall portion of the second track portion.

5. The tower elevating assembly of claim 1, wherein the tower elevating assembly further includes an actuation system for moving the carriage assembly between the first and second elevation positions.

6. The tower elevating assembly of claim 5, wherein the actuation system includes a screw lift transmission.

7. The tower elevating assembly of claim 1, wherein the carriage assembly includes a tower traveling assembly and a platform support assembly.

8. The tower elevating assembly of claim 1, further comprising a user control interface.

9. The tower elevating assembly of claim 8, wherein the user control interface is moveable relative to the platform assembly for user convenience.

10. The tower elevating assembly of claim 1, further comprising a head portion for housing at least some power controls of the tower elevating assembly.

11. The tower elevating assembly of claim 1, further comprising a safety pan assembly extending from a bottom of the platform assembly, wherein the safety pan assembly is configured to be activated by a magnetic reed switch.

12. The tower elevating assembly of claim 1, wherein the leg assembly includes first and second legs extending orthogonal to a longitudinal axis of the single stage tower.

13. A kit for a tower elevating assembly, comprising:

(a) a platform assembly, including a platform having a first and second guard wall, respectively, on first and second ends of the platform and a ramp between the first and second guard walls to enclose the platform, the ramp being retractable to provide an exit from the platform;

(b) a single stage tower having a first end and a second end and including a track assembly, wherein the track assembly includes first and second track portions extending between the first and second ends of the tower, wherein each of the first and second track portions includes at least first and second adjacent channels, wherein each of the first and second track portions is manufactured as a single continuous structure made from extruded aluminum, and wherein a portion of the single continuous structure of each of the first and second track portions divides the first and second adjacent channels of the respective first and second track portions, wherein the first and second track portions are configured such that openings to both of the at least first and second channels of the first track portion face openings to both of the at least first and second channels of the second track portion, wherein the tower further includes a leg assembly extending from a base of the tower, and wherein the tower is configured to be anchored to a ground surface by base attachments points located on the leg assembly; and (c) a carriage assembly configured for coupling with the platform assembly and the tower assembly and configured for movement within the first channels of the first and second track portions, wherein the carriage assembly includes first and second rollers configured for moving within the first channels of the first and second track portions, wherein the first and second rollers are configured to rotate about an axis parallel to a longitudinal axis of the platform, wherein the platform assembly is configured to move along the track assembly between a first elevation position at the first end of the tower to a second elevation position at the second end of the tower, wherein a vertical reach of the platform assembly is limited to a length of the single continuous extruded aluminum first and second track portions.

14. The kit of claim 13, wherein the carriage assembly includes a tower traveling assembly and a platform support assembly.

15. The kit of claim 14, wherein the tower traveling assembly and the platform support assembly are integrated or the tower traveling assembly and the platform support assembly are separable from one another.

16. The kit of claim 13, wherein the platform and the carriage assembly are integrated or the platform and the carriage assembly are separable from one another.

* * * * *